United States Patent [19]

Bratschi

[11] 4,116,257

[45] Sep. 26, 1978

[54] STRIP CURTAIN

[76] Inventor: Konrad Bratschi, Haldenweg 29, 3074 Muri, Switzerland

[21] Appl. No.: 787,168

[22] Filed: Apr. 13, 1977

[30] Foreign Application Priority Data

Apr. 17, 1976 [DE] Fed. Rep. of Germany ... 7612227[U]

[51] Int. Cl.[2] ..... E06B 9/30

[52] U.S. Cl. ..... 160/168 R

[58] Field of Search ..... 160/166–178, 160/84 R, 348; 16/87 R, 87.2, 87.4, 87.6

[56] References Cited

U.S. PATENT DOCUMENTS

| | | | |
|---|---|---|---|
| 2,756,817 | 7/1956 | Toti | 160/166 A |
| 3,125,154 | 3/1964 | Woodle | 160/178 R |
| 3,296,651 | 1/1967 | Baker | 160/348 |

*Primary Examiner*—Peter M. Caun

*Attorney, Agent, or Firm*—Weiser, Stapler & Spivak

[57] ABSTRACT

Strip curtains having sliding hangers guided in a curtain track and rotatable about the vertical to which free-hanging curtains are removably attached. The sliding hangers are united by connecting members, together forming an articulated series of links capable of being extended and folded. The sliding hangers are juxtaposed and oriented transversely to the curtain track in the folded condition of the series of links and are positioned approximately in the vertical plane defined by the track in the extended condition of the series of links. The curtain panels are snapped onto the sliding hangers.

6 Claims, 11 Drawing Figures

STRIP CURTAIN

The invention relates to a strip curtain having sliding hangers, rotatable about the vertical and guided by a curtain track, and to which free-hanging curtain panels are removably attached.

Various forms of such strip curtains are known, e.g. in conjunction with a scissor frame guided by the curtain track, the individual scissor frame elements having hooks at their ends from which the curtain strips can be suspended. This arrangement is complicated and not esthetically pleasing. Moreover, suspending of the curtain strips from the pointed hooks can cause damage; also the curtain strips can rip or pull out.

In other curtain systems having vertical panels, costly special mechanisms are needed in order to rotate the panels about the suspension axis, or in order to slide them to one side or the other.

Accordingly, it is an object of the present invention to overcome one or more of the foregoing drawbacks of the prior art.

It is another object to overcome certain drawbacks of known strip curtains and vertical venetian blinds and to provide a strip curtain which can be conveniently and simply serviced and economically manufactured.

It is another object to provide such apparatus which affords a variety of possibilities in terms of its specific configuration.

These and other objects of the invention which will appear are achieved by means of a strip curtain in which every two sliding hangers are united by a connecting member. The sliding hangers and connecting members form an articulated series of links capable of being extended or folded together. In the folded condition of the series of links, the sliding hangers are side-by-side and transverse to the curtain track. In the extended condition of the series of links the sliding hangers are at least approximately in the vertical plane of the curtain track. The curtain strips are snapped onto the sliding hangers.

Figure 1:
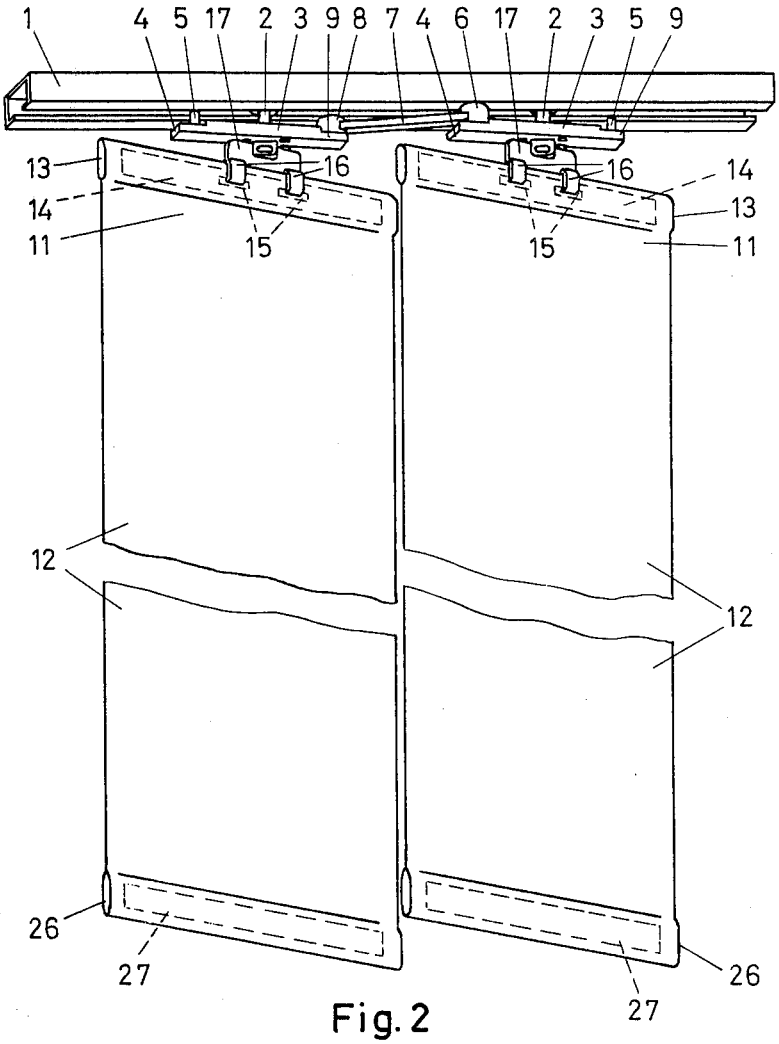
Figure 2:
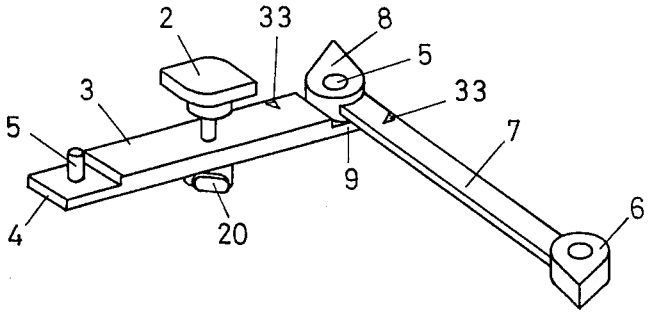
Figure 3:
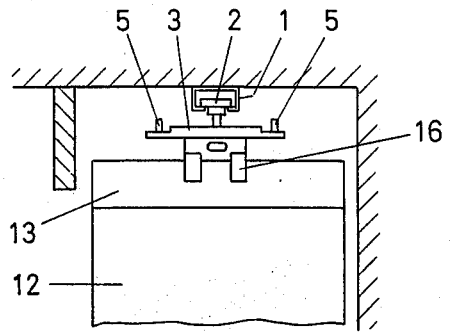
Figure 4:
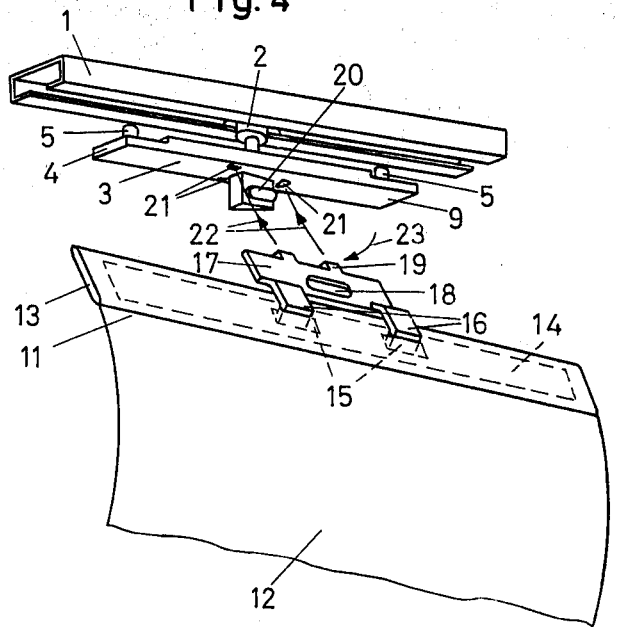
Figure 5:
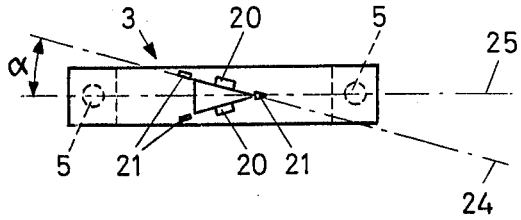
Figure 6:
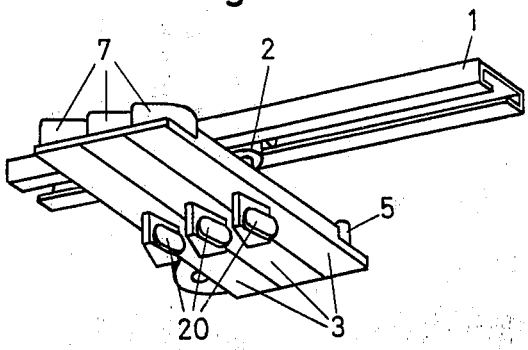
Figure 7A:
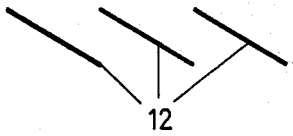
Figure 7B:
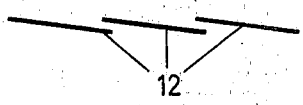
Figure 7C:
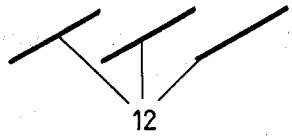
Figure 7D:
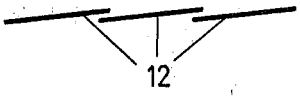
Figure 8:
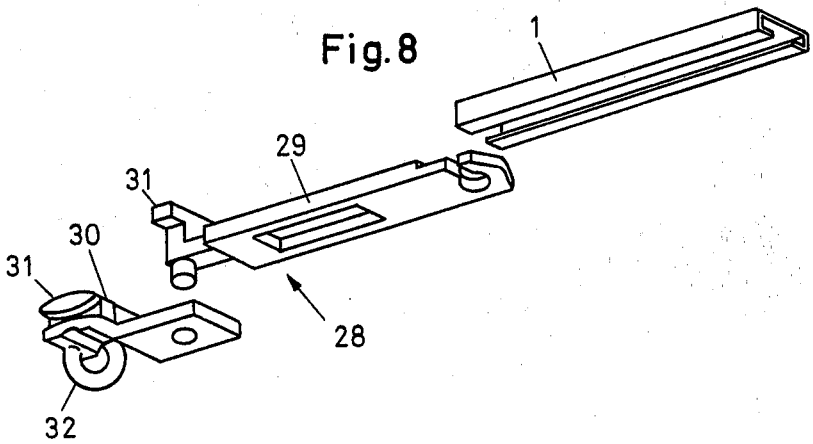

For further details reference is made to the discussion which follows in light of the accompanying drawings wherein:

FIG. 1 is a perspective view of a portion of a strip curtain,

FIG. 2 shows a single sliding hanger, pivotally connected to a connecting member, FIG. 3 is a cross-section through a strip curtain in drawn open condition, with transversely positioned sliding hangers, in which only a single strip with its associated sliding hanger is shown, FIG. 4 shows a single curtain strip about to be snapped onto a sliding hanger, FIG. 5 is a view from below of a sliding hanger, FIG. 6 shows a group of pre-assembled sliding hangers inserted into the curtain track, FIGS. *7a* through *7d* show two possible configurations of the panel strip curtain, FIGS. *7a* and *7b* showing the "left-see-through" or "left closed" configuration and FIGS. *7c* and *7d* the "right-see-through" or "right closed" configuration, and FIG. 8 shows a two-part master slide about to be inserted into the curtain track.

The strip curtain may be drawn by hand, by strings, or electrically. It includes a curtain track 1 attached to the overhead. Within this track, sliding hangers 3 equipped with glides 2 are guided displaceably and rotatably about the vertical axes of the glides. One end

4 of a first sliding hanger 3 is pivotally connected by means of a pin 5 with end 6 of connecting member 7, whose opposite end 8 is in turn pivotally connected with another end 9 of a second sliding hanger 3, and so on. Sliding hangers 3 and connecting members 7 thus forming an articulated series of links which are extendable and foldable. In the extended condition of the series of links, the axes of the sliding hangers and connecting members, which are slightly angled with respect to each other, lie approximately in the vertical plane of the curtain track. In the closed condition of the link series, the sliding hangers are adjacent to each other, and approximately transverse to the vertical plane of the curtain track.

To each sliding hanger 3 a curtain strip 12 is removably attached. As is best seen in FIGS. 1 and 4, the upper end 11 of the curtain strip 12 is provided with a seam 13 into which an elongated reinforcing plate 14 is inserted. This plate 14 exhibits in its middle two apertures into which there are removably engaged two elastic clamping fingers 16 of a plastic holder 17 pushed down over the upper end 11. Holder 17 in turn has an aperture 18 and above it two projections 19 which cooperate respectively with a corresponding knob 20 and two apertures 21 in sliding hanger 3. To attach curtain strip 12 to sliding hanger 3, the former is inserted into the sliding hanger diagonally from below, in the direction of arrow 22, and is then laterally pressed down in the direction of arrow 23, so that knob 20 engages aperture 18. Surface 24 of the curtain strip 12 thereby forms with the axis 25 of sliding hanger 3 an acute angle $\alpha$ (FIG. 5). Since sliding hanger 3 is symmetrical, the curtain strip could also be clipped onto the other side of the hanger. In one attachment configuration of curtain strips 12, these touch each other when the series of links is fully extended, thereby completely closing the strip curtain (FIGS. *7b, 7d*). In the other attachment configuration the curtain strips are spaced from each other when the series of links are fully extended (FIGS. *7a, 7c*) so that it is possible to see through the curtain from the left or from the right.

In order that the individual curtain strips 12 shall hang properly in their suspended condition, it is necessary to sew seams 13, 26 at a precise right angle or, alternatively, to glue them in such position when plastic material is used. For weighting, there is used a bottom plate 27 which is inserted in bottom seam 26.

From the fact that the curtain strips are easy to hang, remove and rehang, significant advantages accrue with respect to configuration, cleaning and repair.

Printed markings 33 (FIG. 2) on the sliding hangers 3 and connecting members 7 facilitate the correct assembly of these two components. In the present instance, arrow points 33 must always point in directions opposite to each other. For disassembly, the sliding hanger can be held fast with one hand while the connecting member is pulled up with the other hand.

The strip curtain may be used, for example, for window walls, as a room divider or as wall decoration, to mention just a few possibilities. A significant advantage resides in the fact that the curtain can be used even with curved tracks. With appropriate track profiles, radii as small as 10 centimeters are feasible.

Assembly of the curtains is simple because the sliding hangers interconnected by connecting members can be delivered in a pre-assembled package, and then need simply be inserted in the curtain track channel. In so doing, allowance must be made for sliding hangers which permit looking through left or right when the series of links is fully extended.

Different tracks, all of which may also be curved, are used depending upon the application as hand, string, or electrically operated type. In each case, the sliding hangers inserted into the appropriate tracks are then connected to the corresponding master slide.

FIG. 8 shows, by way of illustration, a two-part master slide 28 for a hand-drawn, one part curtain, slidable towards one side. Both components 29, 30 of the master slide are pivotally connected to each other and provided with glides 31. One component 29 is attached to the pivot pin 5 of the first sliding hanger 3 and the loop of the other component 30 is connected to the pull string. The curtain strips which are to be attached to the sliding hangers, and which are made of textile or plastic material, can be prefabricated in various patterns and lengths, or can be custom made for special installations. After attachment of the plastic holder, the strips can be mounted on the sliding hangers with two simple hand movements, any desired combinations of patterns and colors being feasible. The strips can be removed quickly and easily, cleaned and remounted or interchanged.

I claim:

1. A strip curtain having sliding hangers guided in a curtain track and rotatable about the vertical to which freehanging curtain strips are removably attached, characterized in that every two sliding hangers are interconnected by a connecting member, the sliding hangers and the connecting members forming an articulated series of links capable of being extended and folded, the sliding hangers being constructed so as to be juxtaposed and oriented transversely to the curtain track in the folded condition of the series of links, and to be positioned at least approximately in the vertical plane defined by the track in the extended condition of the series of links, the upper end of the curtain strip having an upper seam reinforced by an elongated plate inserted in the seam, and a holder pushed down over the upper end, the plate having apertures and the holder having corresponding protrusions removably engageable in the apertures of the plate, the sliding hanger having a member cooperating with the holder onto which the holder can be snapped in either of two positions, the plane of the curtain strip forming an acute angle $\alpha$ with the axis of the sliding hanger whereby, in either of said positions, the curtain strips touch each other in the one position and are spaced from each other in the other position when the series of links is extended, and the curtain strips being snapped onto the sliding hangers.

2. The curtain of claim 1 comprising a plurality of preassembled hangers and connecting members.

3. The curtain of claim 1 wherein the connecting members are constructed so as to be attached to the track only indirectly through the hangers.

4. The curtain of claim 1 wherein the member cooperating with the holder is a knob protruding downwardly from the sliding hanger and in the shape of an isosceles triangle with its axis of symmetry parallel to the hanger axis, the holder being adapted to be positioned adjacent either side of the triangle.

5. The curtain of claim 4 wherein the knob has a protrusion from each triangle side face, and the holder having an aperture for engagement by the protrusion from one or the other face.

6. The curtain of claim 5 wherein the hanger has a recess adjacent each corner of the triangle, and the hanger has protrusions for engagement into the recess at the apex and into one or the other recess at the base of the triangle.

* * * * *